US008979228B2

(12) United States Patent
Nishi

(10) Patent No.: US 8,979,228 B2
(45) Date of Patent: Mar. 17, 2015

(54) INKJET RECORDING APPARATUS

(75) Inventor: Yasuo Nishi, Hachioji (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/497,969

(22) PCT Filed: Sep. 7, 2010

(86) PCT No.: PCT/JP2010/065289

§ 371 (c)(1),
(2), (4) Date: Mar. 23, 2012

(87) PCT Pub. No.: WO2011/037006

PCT Pub. Date: Mar. 31, 2011

(65) Prior Publication Data

US 2012/0182337 A1 Jul. 19, 2012

(30) Foreign Application Priority Data

Sep. 28, 2009 (JP) ..... 2009-222618

(51) Int. Cl.
*B41J 2/06* (2006.01)
*B41J 2/41* (2006.01)
(Continued)

(52) U.S. Cl.
CPC ..... *B41J 2/145* (2013.01); *B41J 2/2132* (2013.01); *B41J 2/095* (2013.01); *B41J 2/2128* (2013.01); *B41J 11/002* (2013.01); *B41J 29/393* (2013.01); *B41J 2002/14459* (2013.01)
USPC ..... 347/9; 347/55; 347/74; 347/76

(58) Field of Classification Search
CPC ..... B41J 2/41; B41J 2/4155; B41J 2/06; B41J 2/085; B41J 2/075; B41J 2/115; B41J 2/02; B41J 2/03; B41J 2/09
USPC ..... 347/41, 54, 55, 47, 102, 5, 9–14, 74, 76
See application file for complete search history.

(56) References Cited

U.S. PATENT DOCUMENTS 4,228,438 A 10/1980 Vazirani
4,391,369 A 7/1983 Stahl et al.
(Continued)

FOREIGN PATENT DOCUMENTS

EP 0473179 A2 8/1991
GB 2324765 A * 11/1998
(Continued)

OTHER PUBLICATIONS

Branham, Machine Translation of "JP 10278252 A—Machine Translation", Oct. 1998.*
(Continued)

*Primary Examiner* — Geoffrey Mruk
*Assistant Examiner* — Scott A Richmond
(74) *Attorney, Agent, or Firm* — Cantor Colburn LLP

(57) ABSTRACT

Provided is an inkjet recording apparatus capable of recording a high quality image without limiting the kinds of ink or recording media, including an inkjet head having a plurality of nozzles to eject ink droplets, wherein the ink droplets ejected from the plurality of the nozzles is charged by applying voltage between the inkjet head and the recording medium, and land on the recoding medium so as to record the image on the recording medium, wherein after a first ink droplet lands on the recording medium, a second ink droplet lands on the recording medium so as to overlap with the first ink droplet before discharging of the first ink droplet is completed.

5 Claims, 7 Drawing Sheets

(51) Int. Cl.

| | |
|---|---|
| ***B41J 2/095*** | (2006.01) |
| ***B41J 2/145*** | (2006.01) |
| ***B41J 2/21*** | (2006.01) |
| ***B41J 11/00*** | (2006.01) |
| ***B41J 29/393*** | (2006.01) |
| *B41J 2/14* | (2006.01) |

(56) References Cited

U.S. PATENT DOCUMENTS

| | | | | |
|---|---|---|---|---|
| 4,484,948 | A | 11/1984 | Merritt et al. | |
| 5,144,340 | A * | 9/1992 | Hotomi et al. | 347/55 |
| 5,686,944 | A * | 11/1997 | Takagi et al. | 347/41 |
| 5,835,113 | A * | 11/1998 | Hirahara et al. | 347/55 |
| 6,158,844 | A * | 12/2000 | Murakami et al. | 347/55 |
| 2003/0210300 | A1* | 11/2003 | Silverbrook | 347/54 |
| 2004/0041892 | A1* | 3/2004 | Yoneyama et al. | 347/102 |
| 2004/0183860 | A1* | 9/2004 | Furukawa | 347/55 |
| 2005/0024439 | A1* | 2/2005 | Fukunaga et al. | 347/55 |
| 2006/0023030 | A1* | 2/2006 | Kaneko | 347/55 |
| 2007/0146433 | A1* | 6/2007 | Kusunoki | 347/55 |
| 2007/0211105 | A1* | 9/2007 | Furukawa | 347/45 |
| 2009/0115811 | A1* | 5/2009 | Yamanobe | 347/15 |

FOREIGN PATENT DOCUMENTS

| | | | |
|---|---|---|---|
| JP | 5-64667 | A | 3/1993 |
| JP | 7-224241 | A | 8/1995 |
| JP | 10278252 | A * | 10/1998 |
| JP | 2002-36563 | A | 2/2002 |
| JP | 2004-114378 | A | 4/2004 |
| JP | 2006-76202 | A | 3/2006 |
| JP | 2008-194943 | A | 8/2008 |

OTHER PUBLICATIONS

International Search Report for International Application No. PCT/JP2010/065289, mailed Oct. 12, 2010, with English translation.

Extended European Search Report for Application No./Patent No. 10818682.6-1701/2484525, mailed Apr. 28, 2014.

* cited by examiner

INKJET RECORDING APPARATUS

CROSS REFERENCE TO RELATED APPLICATIONS

This is a U.S. national stage of application No. PCT/JP2010/065289, filed on 7 Sep. 2010. Priority under 35 U.S.C. §119(a) and 35 U.S.C. §365(b) is claimed from Japanese Application No. 2009-222618, filed 28 Sep. 2009, the disclosure of which are also incorporated herein by reference.

TECHNICAL FIELD

The present invention relates to an inkjet recording apparatus.

PRIOR ART

In the past, there has been known an inkjet recording apparatus to record a desired image on a recording medium by ejecting an ink droplet ejected from an inkjet head. The inkjet recording apparatus is variously-used, and various kinds of ink and the recording media suitable for respective purposes are available.

However, in the inkjet recording apparatus, in order to achieve a high image quality, an exclusive sheet having an ink absorption property had to be used as the recording medium. For example, in case a coated paper or an art paper having poor ink absorption property or a plastic film having no ink absorption property is used as the recording medium, there were occurred phenomenons, such as beading in which ink droplets stick with each other on the recording medium to form lumps and color bleeding in which ink droplets having different colors mix with each other on the recording medium to cause color bleed, which deteriorate image quality.

Then, several methods are suggested to prevent occurrence of beading and color bleeding.

One method is that a hot-melt type ink composition based on a solid wax at room temperature is heated to melt and ejected so that the hot-melt type ink droplet lands on the recording medium and solidified by cooling, whereby a recording dot is formed (for example, Patent Documents 1 and 2: U.S. Pat. Nos. 4,391,369 and 4,484,948). In the above method since the ink droplet can be solidified immediately after landing, the beading and color bleeding can be prevented irrespective of the kind of the recording medium.

In another method, there is suggested to use ink solidified by radiating activation light beam (for example, Patent Document 3: U.S. Pat. No. 4,228,438). Also, as a similar method as above, there is suggested a method to use a nonaqueous ink containing ketone and alcohol as a main solvent and polyacrylate having three or more functional groups as a polymeric material, besides a pigment as a colorant (for example, Patent Document 4: H5-64667). In the above methods by reacting curable components, the ink droplet can be cured immediately after landing, whereby occurrence of the beading and color bleeding can be prevented irrespective of the kind of the recording medium.

Further, a method to use aqueous ink containing ultraviolet polymerization monomer is suggested (for example, Patent Document 5: Unexamined Japanese Patent Application Publication No. H7-224241). In the above method, the ink droplet can be cured immediately after landing by being irradiated by an ultraviolet ray, whereby diffusion is prevented irrespective of the kind of the recording medium. Also occurrence of the beading and color bleeding, as well as strike-through in case of the ordinary paper can be prevented.

PRIOR ART DOCUMENT

Patent Document

Patent Document 1: U.S. Pat. No. 4,391,369, Specification
Patent Document 2: U.S. Pat. No. 4,484,948, Specification
Patent Document 1: U.S. Pat. No. 4,228,438, Specification
Unexamined Japanese Patent Application Publication No. H5-64667
Unexamined Japanese Patent Application Publication No. H7-224241

DISCLOSURE OF THE INVENTION

Problems to be Solved by the Invention

However, in the methods disclosed in the above Patent Documents 1 to 5, other problems have occurred by restricting the kind of ink.

For example, in the methods cited in Patent Documents 1 and 2, ink is limited to a kind of ink to form a wax-like soft ink droplet. Thus a recorded dot formed by the above ink droplet projects from a surface of the recording medium. When the dot is floated by a roller, there were problems that unnatural gloss cased by diffused reflection of light occurs on the surface thereof and abrasion property is deteriorated.

In the Patent Documents 3 and 4, the kind of ink is limited to the one containing a large amount of the nonvolatile curable component. Thus, there occur problems of unnatural gloss and insufficient abrasion property in the same manner as above, since the recorded dot projects. In addition, since the curable components contained in the ink is limited in selecting chemical compounds from a view point of safety with respect to a human body, designing flexibility for the property of the ink was limited when selecting the chemical compound.

In the method cited in Patent Document 5, there were problems that if an amount of the ultraviolet polymerization monomer contained is increased, a viscosity of the ink increases, as a result an ejection speed of the ink droplet reduces drastically, on the other hand if the amount of the ultraviolet polymerization monomer contained is decreased, an effect to prohibit diffusion is deteriorated, thus occurrence of the beading and color bleeding cannot be prevented. Namely, the ink is limited to a kind of ink containing an appropriate amount of ultraviolet polymerization monomer.

The present invention has one aspect to solve the above problems and an object of the present invention is to provide an image forming apparatus, which enables a high quality image without limiting to the kinds of the ink and the recording medium.

Means to Solve the Problem

Item 1. To achieve the above object, the image forming apparatus reflecting one aspect of the present invention includes an inkjet head having a plurality of nozzles to eject ink as ink droplets so as to record an image on a recording medium by landing the ink droplets ejected form the plurality of the nozzles on the recording medium while charging the ink droplets, wherein after a first ink droplet lands on the recording medium, a second ink droplet lands on the recording medium so that the second ink droplet overlaps with the first ink droplet before discharging of the first ink droplet is completed.

Item 2. The ink jet image forming apparatus of item 1, wherein a time period from landing of the first ink droplet and to landing of the second ink droplet is not more than 20 m sec.

Item 3. The ink jet image forming apparatus of item 1, wherein the plurality of the nozzles are arranged so that distances among ink ejection ports of the nozzles are not less than 170 μm.

Item 4. The ink jet image forming apparatus of item 1, comprising a radiation device to radiate heat or light to the ink droplets landed on the recording medium, wherein the ink is cured by radiating the heat or the light from the radiation device.

Effects of the Invention

According to the image forming apparatus of item 1, after the first ink droplet lands on the recording medium, the second ink droplet to overlap with the first ink droplet lands before discharging of the first ink droplet is completed, whereby the first ink droplet and the second ink droplet create a repulsive force after landing due to charging. Thus occurrence of beading and color bleed caused by the ink droplets to attract each other is unfailingly prevented. Therefore a high image quality can be achieved unfailingly without being limited by the kind of the recording medium and ink.

According to the image forming apparatus of item 2, since the time period between landing of the first ink droplet and landing of the second ink droplet is not more than 20 m sec, the repulsive force between the ink droplets due to charging can be effectively used. Whereby, occurrence of beading and color bleed caused by the ink droplets to attract each other is unfailingly prevented. Therefore a high image quality can be achieved unfailingly without being limited by the kind of the recording medium and ink.

According to the image forming apparatus of item 3, since the plurality of the nozzles are arranged so that the distance among each inkjet port is not less than 170 μm, each ink droplet ejected from each ink ejection port does not repel each other while flying by the charge. Whereby displacing of the landing position of each ink droplet due to change of the ejection direction of each ink droplet is prevented. Therefore, the deterioration of the image quality is prevented and further high image quality can be achieved.

According to the image forming apparatus of item 4, the ink droplet is cured by the radiation device to radiate heat or light to the ink droplet landed on the recording medium, the ink can be cured quickly while preventing the landed ink droplets to attract each other by the repulsive force due to charging. Whereby, occurrence of beading and color bleed caused by the ink droplets to attract each other is unfailingly prevented. Therefore a high image quality can be achieved unfailingly without being limited by the kind of the recording medium and ink.

DESCRIPTION OF THE PREFERRED EMBODIMENTS

Preferred embodiments of the present invention will be described as follow with reference to the drawings.

Figure 1:
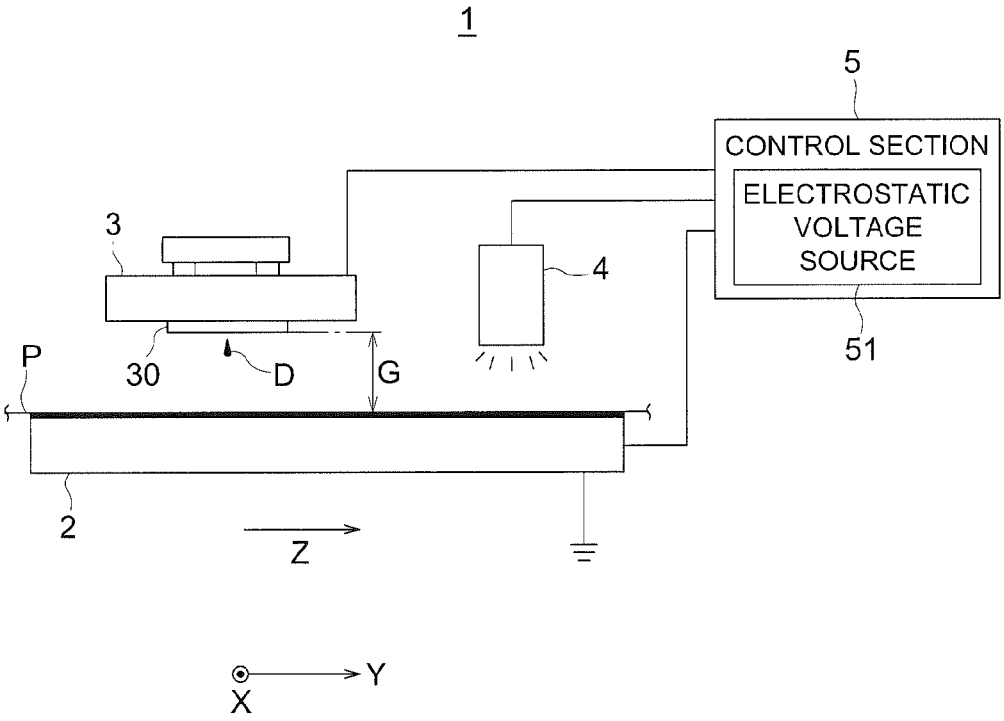
FIG. 1 is a schematic diagram showing a relevant section of an inkjet recording apparatus.

FIG. 1 is a schematic diagram showing a relevant portion of an inkjet recording apparatus 1 related to the present invention.

As the figure shows, an inkjet recording apparatus 1 is provided with a conveyance section 2 to convey a recording medium P in a direction of an arrow Z (hereinafter called conveyance direction Z). The conveyance section 2 is grounded to be kept at a ground voltage. As the recording medium P, besides papers and textiles, plastic films and metals having no ink absorption property can be used without being limited thereto. Incidentally, papers obviously include an exclusive paper having the ink absorption property for the inkjet printer, also includes a coated paper and an art paper having an inferior ink absorption property.

Above the conveyance section 2, there is disposed an inkjet head 3 to eject an ink droplet D towards the recording medium P on the conveyance section 2. In the inkjet head 3 a plurality of nozzles 301 to eject the ink droplets D are arranged in a X direction and a Y direction in the figure (refer to FIG. 2).

Also, a radiation device 4 to radiate an ultraviolet ray to the ink droplet D landed on a surface of the recording medium P is disposed above the conveyance section 2 on a downstream side of the inkjet head 3 in the conveyance direction Z.

The above conveyance section 2, the inkjet head 3 and the radiation device 4 are connected to a control section 5 so as to be controlled by the control section 5. The control section 5 is provided with an electrostatic voltage power source 51 to apply electrostatic voltage onto a nozzle plate 30 of the inkjet head 3 to be described. By the above electrostatic voltage power source 51*a* predetermined electrostatic voltage can be applied between a lower surface of the nozzle plate 30 and an upper surface of the conveyance section 2 and eventually applied to a gap G between a lower surface of the nozzle plate 30 and an obverse surface of the recording medium P.

Figure 2:
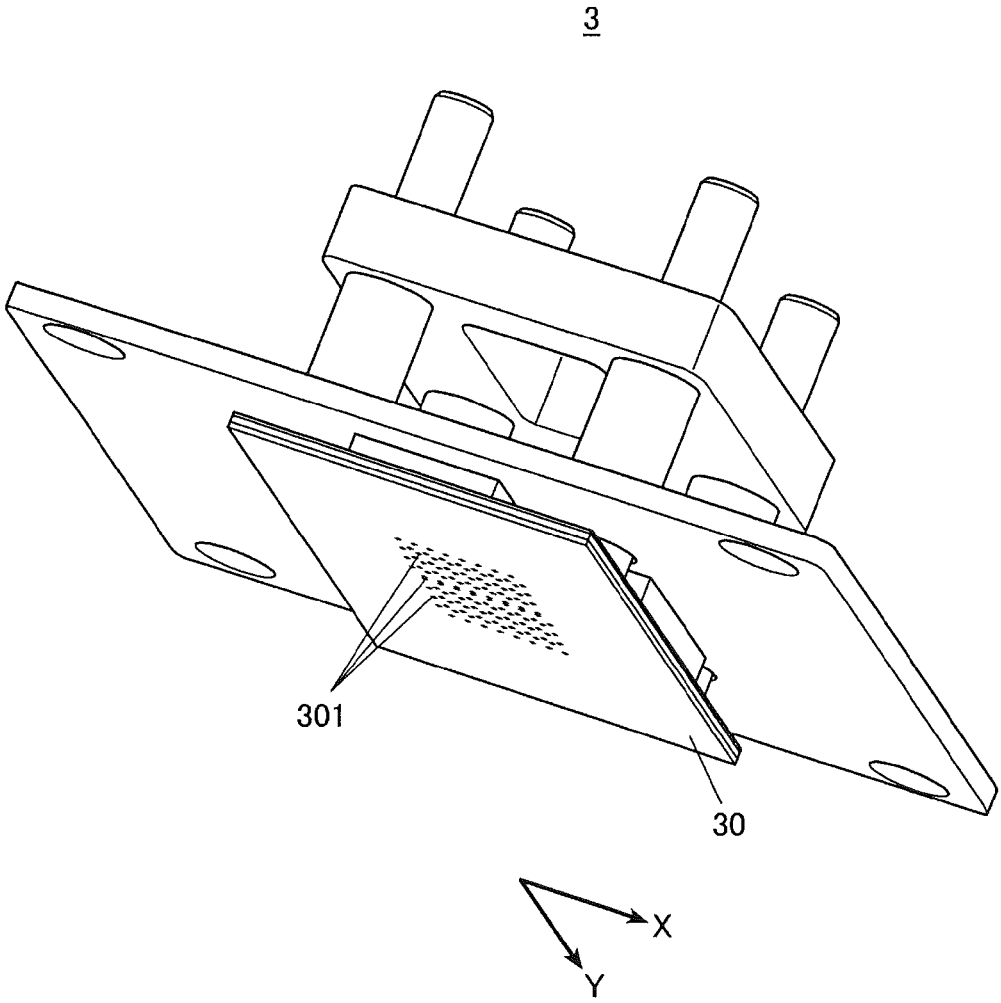
FIG. 2 is a perspective view of an inkjet head.

FIG. 2 is a perspective view of the inkjet head 3.

As the figure shows, at a lower end of the inkjet head 3, a nozzle plate 30 provided with a plurality of nozzles 301 to eject the ink droplets D are disposed.

Figure 3:
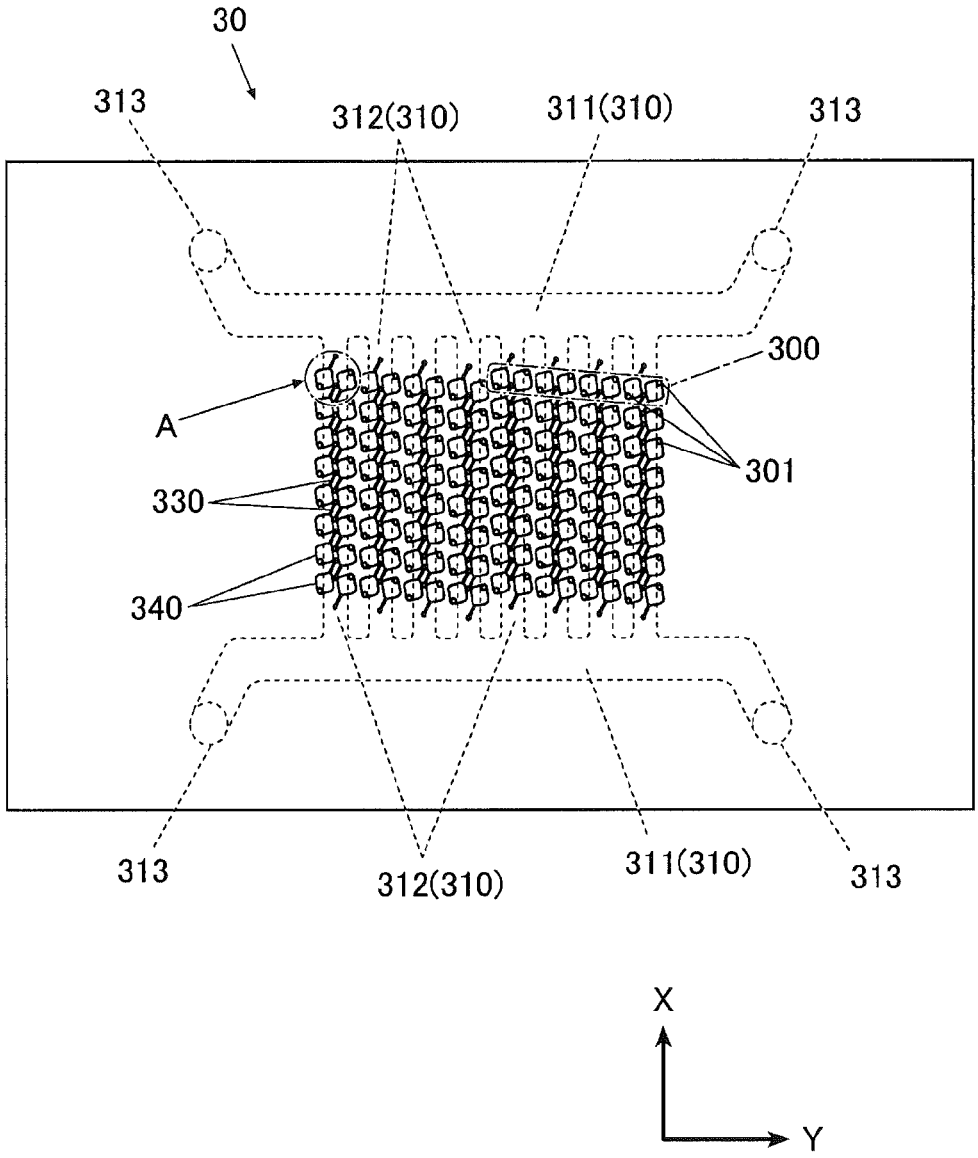
FIG. 3 is a bottom view of a nozzle plate.

FIG. 3 is a bottom view of the nozzle plate 30. In the figure, a venturi flow path 330 and a pressure chamber 340 are shown by solid lines for understanding of the figure.

As the figure shows, the nozzle palate 30 is provided with a plurality of nozzle arrays 300. The nozzle array 300 is configured with eight nozzles 301 in the present embodiment. Specifically, the nozzle array 300 includes two nozzle sets, wherein each nozzle set is configured with four nozzles 301, which are arranged in a line obliquely with respect to the Y direction while positions of the nozzles 301 in the X direction are slightly overlapping. In the two nozzle sets, as to a nozzle 301 on an end of one nozzle set and a nozzle 301 on another end of another nozzle set, the positions of the above two nozzles 301 in the X direction are slightly overlapped and the four nozzles 301 in each nozzle set are arranged alternately in the Y direction. Two nozzle arrays 300 are arranges in the Y direction in a way that the position in the X direction of the each nozzle 301 are slightly overlapped alternately (refer to FIG. 7*a*), and eight nozzle arrays 300 are arranged in the X direction in a way that the position of each nozzle 301 in the Y direction coincides. Namely a total of 16 nozzle arrays 300 are disposed, and a total of 128 nozzles 301 are arranged in eight arrays in the X direction and in 16 arrays in the Y direction.

Also, in the nozzle plate 30, an ink channel 310 is formed to supply ink to each nozzle. The ink channel 310 has two collecting channels 311 and eight branch channels 312.

The two collecting channels 311 are formed at both sides of a nozzle forming area in the X direction to have all the nozzles 301 in between them and the both ends of each collecting channels 311 are communicated with ink supply ports 313.

On the other hand, the eight branch channels 312 are communicating with each collecting channel 311. Also, each branch channel 312 is elongate in the Y direction and disposed in parallel in the Y direction to supply ink to the nozzles 301 arranged in 16 nozzle arrays in the Y direction. Each branch channel supplies ink to two arrays of nozzles 301.

Figure 4:
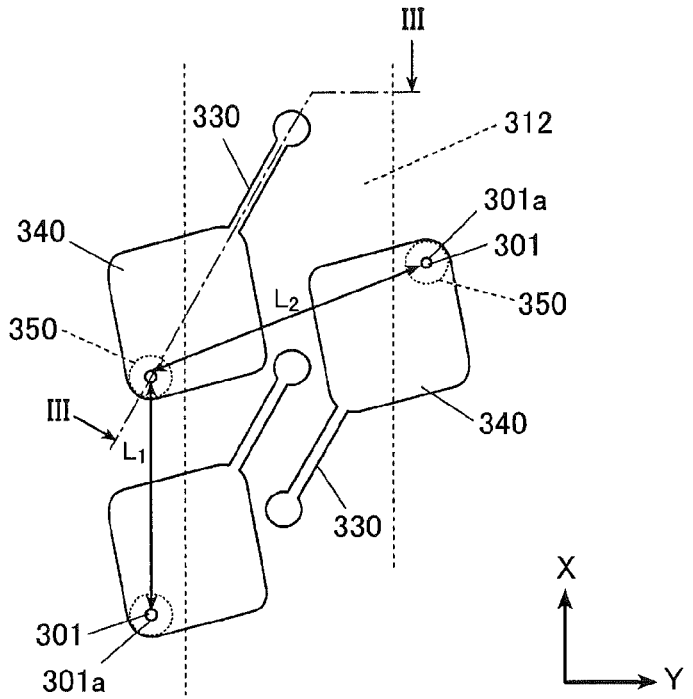
FIG. 4 is a magnified view of A section in FIG. 3.
Figure 5:
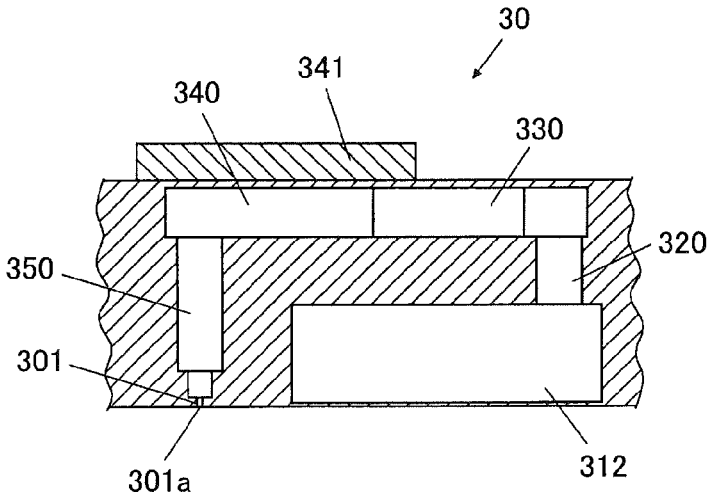
FIG. 5 is a cross-sectional view section of a nozzle plate in FIG. 4

FIG. 4 is a magnified drawing of A section in FIG. 3, and FIG. 5 is a cross-sectional drawing of 111-111 section of the nozzle plate 30 in FIG. 4.

As the above figures show, the branch channel 312 is communicating with the nozzle 301 via an ink supply channel 320, the venturi flow path 330, the pressure chamber 340 and an opening section 350 in descending order.

The ink supply channel 320 and the venturi flow path 330 are channels to supply ink from the branch channel 312 to the pressure chamber 340.

The pressure chamber 340 is a chamber to eject ink from the nozzle 301 via the opening section 350 and formed to be substantially a square 450 μm on a side. Above the pressure chamber 340, a piezoelectric element 341 is disposed.

The piezoelectric element 341 is an actuator configured with PZT (lead zirconium titanate) which pushes ink in the pressure chamber 340 towards the opening section 350 by deformation when voltage is applied. The ink pushed out is ejected as a fine ink droplet via the opening section 350 from the ink ejection port 301*a* of the nozzle 301 which opens at the lower surface of the nozzle plate 30.

Also, the plurality of the nozzles 301 are configured so that a distance between each ink ejection port 301*a* is not less than a predetermined distance. In the present embodiment, the distance is not less than 170 μm. Namely, a distance $L_1$ between the in ejection ports 301*a* adjacent to each other in the X direction and a distance $L_2$ between the ink ejection ports 301*a* adjacent to each other substantially in the Y direction are not less than 170 μm.

However, the distances $L_1$ and $L_2$ between the ink ejection ports 301*a* adjacent to each other do not have to be not less than 170 μm, if deterioration of the image quality can be prevented with the distances.

The ink droplet D ejected form the ink ejection port 301*a* is charged in the gap G as described later. Thus by the charging two ink droplets D ejected from adjacent ink ejection ports 301*a* produce repulsive forces each other while flying. When this occurs, if the distances $L_1$ and $L_2$ between the ink ejection ports 301*a* adjacent to each other are too short, the above repulsive forces become greater than a force to fly the ink droplet D in an ejection direction. As a result, the ejection direction of the ink droplet D is changed and the landing position of the ink droplet D displaces then the image quality is deteriorated. Therefore, by adjusting the distances $L_1$ and $L_2$ between the adjacent ink ejection ports 301*a* so that the above repulsive forces are smaller than the force to fly the ink droplets D in the ejection direction, the phenomenon that the image quality is deteriorated is prevented.

Ink used in the inkjet recording apparatus is so-called UV curable ink cured by being irradiated by the ultraviolet ray. An electrical conductivity of the above ink is preferably to be not less than 1 μS/cm and not more than 1000 μS/cm for an appropriate electrostatic attraction force working on the ink droplet D, and more preferably not less than 100 μS/cm from the aspect of achieving high quality image.

The inkjet recording apparatus 1 provided with the aforesaid configurations is so-called a single path method apparatus which records desired image by landing the ink droplets D while conveying the recording medium P in the conveyance direction Z. At the same time the inkjet recording apparatus 1 is also so-called an electrostatic attraction method apparatus which applies electrostatic voltage to the gaps G between the nozzle plate 30 and the recording medium P, and charges the ink droplet D flying in the gap G so that the electrostatic attraction force affect the ink droplet D then records the image. The inkjet recording apparatus 1 is capable of recording an image of 600 dpi, namely a pitch between the dots is approximately 42.3 μm.

Next, operation of the inkjet recording apparatus 1 to record the image on the recording medium P will be described with reference to FIG. 6 and FIG. 7. Here, an example of drawing a single line as the image will be cited.

Figure 6:
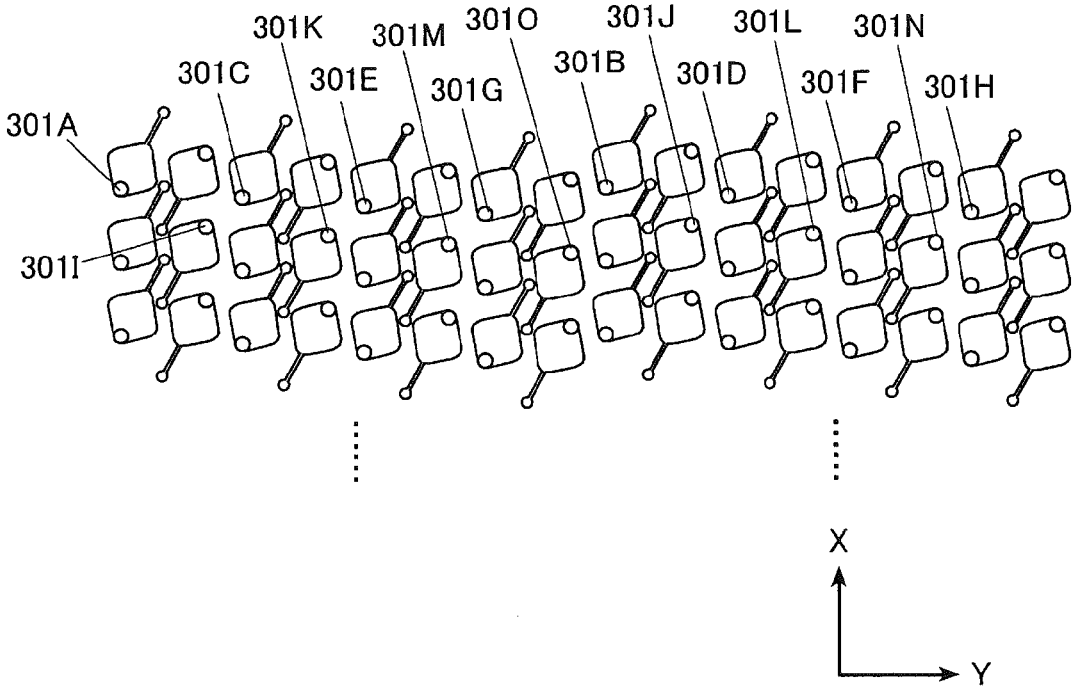
FIG. 6 is a layout drawing of nozzles as viewed from underneath.
Figure 7A:
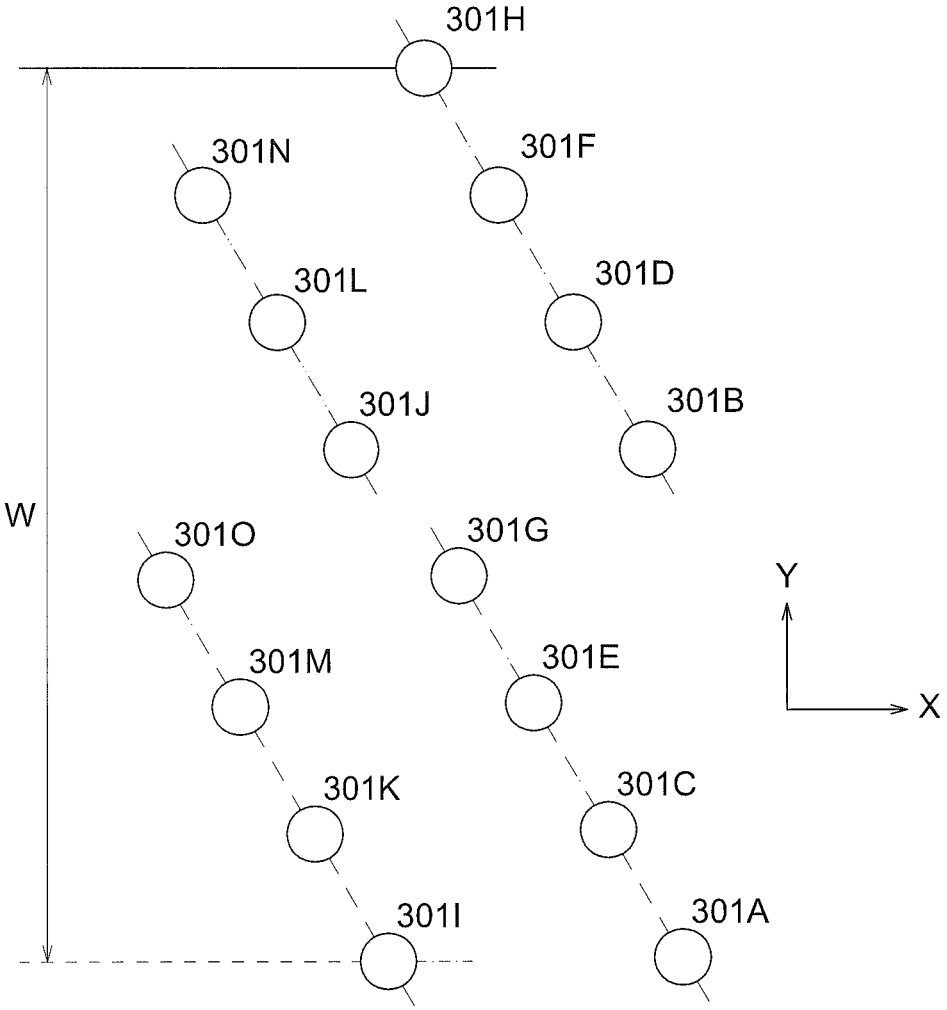
FIG. 7*a* is a diagram describing ejection sequences of ink droplets from nozzles.
Figure 7B:
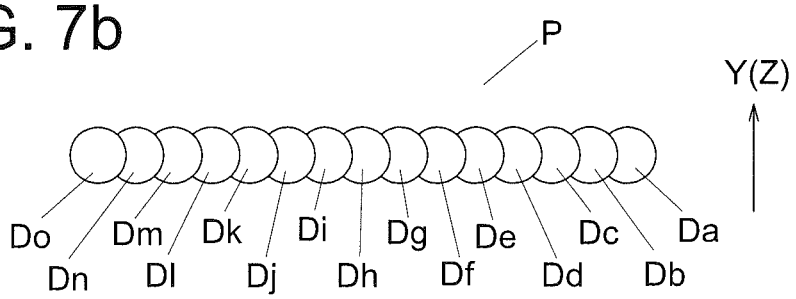
FIG. 7*b* is a diagram describing landing sequences of ink droplets on a surface of the recording medium.

FIG. 6 is a layout drawing of nozzles as viewed from underneath. FIG. 7*a* is a diagram describing ejection sequences of the ink droplets D from the nozzles 301, and FIG. 7*b* is a diagram describing landing sequences of the ink droplets D on the surface of the recording medium P.

Incidentally, in the following description, as FIG. 6 shows, some nozzles 301 are distinguished as nozzles 301A to 301O. Also, the ink droplets D ejected form the nozzles 301A to 301O are distinguished as the ink droplets Da to Do.

First, the control section 5 controls the electrostatic voltage power source 51 so as to apply electrostatic voltage onto the nozzle plate 30 of the inkjet head 3. Thus the gap G between the lower surface of the nozzle plate 30 and the obverse surface of the recording medium P is in a state that a predetermined electrostatic voltage is applied. Whereby, a static electric field is formed in the gap G and electric lines of force are formed from the nozzle plate 30 to the recording medium P. Here, the predetermined electrostatic voltage means a voltage per unit length of the gap G of not less than 500V/mm and not more than a breakdown voltage of air.

Next, the control section 5 controls the conveyance section 2 so as to convey the recording medium P stacked in the conveyance section 2 in the conveyance direction Z at a predetermined speed.

Next, the control section 5 controls the inkjet head 3 to eject the ink droplet Da from the nozzle 301A. The ink droplet Da is ejected while being charged by the electrostatic field formed in the gap G. In this instance, a volume of the ink droplet Da to be ejected is preferred to be not more than 3 pl. The charged ink droplet Da flies along the electric lines of force formed in the gap G while being affected by the electrostatic attraction force. Thereafter the ink droplet Da lands on the surface of the recording medium P and charge is emitted to the conveyance section 2 namely the ink droplet Da is discharged.

Also, the control section 5 ejects the ink droplet Db from a nozzle 301B at a predetermined timing before the ink droplet Da lands on the surface of the recording medium P. Here, the predetermined timing means a timing in which the ink droplet Db lands on the surface of the recording medium P so as to overlap with the ink droplet Da after the ink droplet Da lands on the surface of the recording medium P and before discharging is completed. The ink droplet Db flies in the gaps G while being charged and affected by the electrostatic attraction force in the same manner as the ink drop let Da.

After the ink droplet Da lands on the surface of the recording medium P, the ink droplet Db lands so as to overlap with the ink droplet Da before discharging of the ink droplet Da is completed. When this occurs, a time period from landing of the ink droplet Da to landing of the ink droplet Db is preferred to be not more than the 20 m sec which is a time period from landing of the ink droplet Da to completion of discharging.

Also, the control section 5 sequentially ejects the ink droplets Dc to Do from the nozzles 301C to 301O at predetermined timings in the same manner as the ink droplet Db which is ejected at the ejection timing with respect to the ink droplet Da. As above, the ink droplets Dc to Do sequentially land on the surface of the recording medium P in a way that each ink droplet D lands after landing of former ink droplets D and before discharging of the former ink droplets D to which the subsequent ink droplets D overlap.

Incidentally, among the distances in the Y direction (conveyance direction Z) between nozzles 301 to eject the ink droplet D to be overlapped, a distance W between the nozzle 301I and the nozzle 301H is longest due to the arrangement of the nozzles 301. Namely, the time period between landings of the ink droplet Di and the ink droplet Dh, which are ejected from nozzles 3201I and 301H respectively, is the longest among the time periods between landings the ink droplets D to be overlapped each other. The control section 5 ejects the ink droplet Di and the ink droplet Dh from the nozzle 301I and the nozzle 301H so that the longest time period between landings is not more that 20 m sec.

Also, the control section 5 ejects the ink droplets D from the nozzles 301 besides the nozzles 301A to 301O respectively in the same manner as needed Next, the control section 5 controls the radiation device 4 to radiate the ultraviolet ray to the ink droplets D landed on the surface of the recording medium P. Specifically, the control section 5 radiates the ultraviolet ray with respect to the surface of the recording medium P passing through beneath the radiation device 4 along with conveyance by the conveyance section 2. Whereby, the ink droplets D landed on the surface of the recording medium P is cured and fixed as the recoding dots to record the image. Incidentally, it is preferred that radiation of the ultraviolet ray by the radiation device 4 is conducted sequentially and quickly with respect to the recording medium P passing through beneath the radiation device 4 along with ejection of the ink droplets D from the nozzles 301, and the ink droplet D is cured before discharging of the ink droplet D.

According to the above inkjet recording apparatus 1, since the ink droplet D to overlap with the former ink droplet D lands after landing of former ink droplet D on the recording medium and before completion of discharging of the former ink droplet D, the repulsive force is created between the above two ink droplets D by each charging. Whereby, occurrence of beading and color bleeding caused by attracting landed ink droplets D each other is prevented. Thus a high quality image can be realized without being limited to the kinds of the ink and the recording media.

Also, since the time period from landing of the ink droplet D on the recording medium P to landing of the successive ink droplet D is not more than 20 m sec, the repulsive force by charging between the ink droplets D can be effectively used. Whereby, the beading and the color bleeding occurred by attracting the landed ink droplets D each other can be unfailingly preventied. Thus a high quality image can be unfailingly realized without being limited to the kinds of ink and the recording media.

Also, since the distance between each ink ejection ports 301*a* of the plurality of the nozzles 301 is not less than 170 μm, each ink droplet D does not repel each other by the charging during flying. Thus displacing of the landing position due to change of the ejection direction of the ink droplet D is prevented. Whereby, deterioration of the image is prevented and the high quality image can be achieved.

Also, in case the ink droplet D landed on the recording medium P is cured quickly by the radiation device 4, the beading and the color bleeding caused by attracting the landed ink droplets D each other are more unfailingly prevented, and feathering and strike-through, namely irregular bleeding along the fiber of the paper when ordinary paper is used as the recording medium is prevented. Therefore, further high image quality can be achieved unfailingly.

Incidentally, it is to be understood that changes and variations may be made without being limited to the above embodiments.

For example, in the above embodiment, while the radiation device 4 radiates the ultraviolet ray, the radiation device 4 can radiate heat or light to the ink droplet D landed on the recording medium P. In the above case, ink cured by heat or light from the radiation device 4 is used. Specifically, in case heat is radiated from the radiation device 4, aqueous ink, which is cured by increasing viscosity by evaporating solvent is used. Also, in case an activation light is radiated form the radiation device 4, activation light curing ink, which is cured by increasing viscosity by polymerization reaction by receiving the activation light, is used.

EXAMPLE

The present invention will be further specifically described with the examples cited as follow.

As examples of the present invention and comparison examples, line images are formed respectively under the following conditions, and occurrence of ink slippage to cause beading and color bleeding is observed and functional evaluation was carried out.

<Image Forming Conditions>

Inkjet head 3 is used to draw the line images with a single swath. Common image forming conditions for the example and the comparison example are as follow.

Gap G: 1 mm

Recording medium P: Art paper (Paper for printing booklet: OK Kanefuji), exclusive paper for inkjet Ink: Aqueous ink Electric conductivity of ink: 100 μS/cm Volume of ink droplet: 2, 4, 6 pl Distance between nozzles W: 10 mm The following table 1 shows the examples 1 to 3 and the comparison examples 1 to 4, in which the line images were formed by changing an ejection frequency of the ink droplet D, the conveyance speed of the recording medium, the time period between landings of the ink droplets D and applied voltage in the gap G respectively. Incidentally, the time period between the landings of the ink droplets D is a time period between the landings of the ink droplets Dh and Di ejected from the nozzles 301H and 301I wherein the distance between the nozzles 301H and 301I is the longest distance W (=10 mm).

TABLE 1

| | Comparison example 1 | Comparison example 2 | Comparison example 3 | Comparison example 4 | Example 1 | Example 2 | Example 3 |
|---|---|---|---|---|---|---|---|
| Ejection frequency [kHz] | 20 | 40 | 80 | 40 | 40 | 80 | 80 |
| Conveyance speed [mm/sec] | 400 | 800 | 1600 | 400 | 800 | 1600 | 1600 |
| Time period between landings [msec] | 25 | 12.5 | 6.25 | 25 | 12.5 | 6.25 | 6.25 |
| Applied voltage [kV] | 0 | 0 | 0 | 0.5 | 0.5 | 0.5 | 1 |
| Results | No good | No good | No good | No good | Good | Good | Good |

<Result>

Occurrence of ink slippage was verified with respect to the lines formed. The results are shown in above Table 1. Here "No good" in the comparison examples 1 to 4 indicates occurrence of ink slippage and "Good" in the examples 1 to 3 indicates occurrence of ink slippage is prevented. Specifically, the examples 1 to 3 whose results are "Good" show the occurrence of ink slippage prevented compared to the comparison examples in which the image forming conditions are the same and the applied voltage is 0. Further specifically, comparing the Examples 1 with the comparison example 2 and comparing the examples 2 and 3 with the comparison examples 3 respectively, in the example 3, occurrence of ink slippage is further prohibited compared to the example 2.

Figure 8A:
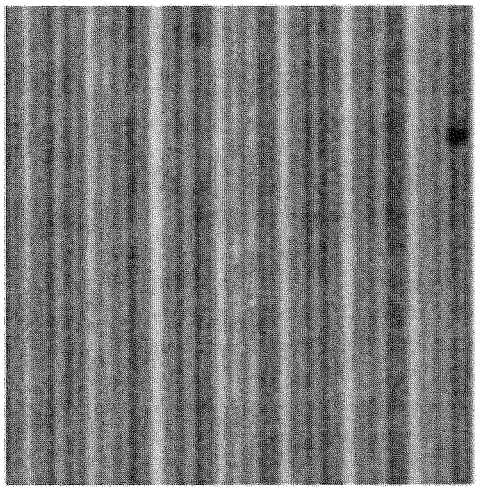
FIG. 8*a* is a diagram showing a preferable example of an image in which ink slippage does not occur.
Figure 8B:
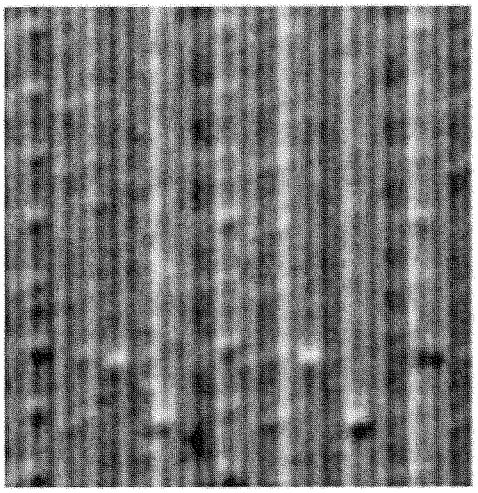
FIG. 8*b* is a diagram showing an example of an image in which ink slippage occurs.

In examples 1 to 3, occurrence of ink slippage is prevented in both cases in which the recording medium is the art paper (paper for printing booklet) and is the exclusive paper for inkjet. Further, in the examples 1 to 3, in any cases of these cases that the volume of the ink droplet D is 2, 4, and 5 pl occurrence of the ink slippage is prevented, and in the case that the volume of the ink droplet D is smaller, the deterrence effect of occurrence of the ink slippage was noticeable. Here a preferable exemplary image in which the ink slippage does not occur is shown in FIG. 8*a* and an exemplary image in which the ink slippage occurs is shown in FIG. 8*b*. In the exemplary image in FIG. 8*b*, a number of ink slippages (black spots) occur which causes a low image quality compared to the exemplary image in FIG. 8*a*.

<SUMMARY>

According the above results, it was revealed that irrespective of the kinds of the recording media P, the ink slippage is prevented in case the time period between landings of ink droplets D is not more than 12.5 m sec which is not more than 20 m sec and the voltage is applied to the gap G.

DESCRIPTION OF THE SYMBOLS

1 Inkjet recording apparatus
3 Inkjet head
4 Radiation device
5 Control section
301 Nozzle
301*a* Ink ejection port
D Ink droplet
G Gap
P Recording medium

What is claimed is:

1. An inkjet image forming apparatus for recording an image on a recording medium, the inkjet image forming apparatus comprising an inkjet head comprising a nozzle plate having a plurality of nozzles and configured to eject ink as ink droplets so as to record the image on the recording medium:

a conveyance section configured to convey a recording medium, wherein the conveyance section is grounded;

a control section configured to apply a predetermined voltage between the nozzle plate and the conveyance section so as to charge each ink droplet in a same polarity:

wherein the control section is configured to control the inkjet head to eject a first ink droplet and a second ink droplet after a predetermined time such that the first ink droplet lands on the recording medium, the second ink droplet lands on the recording medium so that the second ink droplet partially overlaps with the first ink droplet, and the second ink droplet lands on the recording medium before electrical discharging of the first ink droplet is completed.

2. The ink jet image forming apparatus of claim 1, wherein a time period from landing of the first ink droplet and to landing of the second ink droplet is not more than 20 m sec.

3. The ink jet image forming apparatus of claim 1, wherein the plurality of the nozzles are arranged so that distances among ink ejection ports of the nozzles are not less than 170 μm.

4. The ink jet image forming apparatus of claim 1, comprising a radiation device to radiate heat or light to the ink droplets landed on the recording medium, wherein the ink is cured by radiating the heat or the light from the radiation device.

5. A method of recording an image on a recording medium using an inkjet image forming apparatus comprising an inkjet head with a nozzle plate having a plurality of nozzles, the method comprising:

applying a voltage between the inkjet head and a conveyance section for conveying the recording medium, wherein the conveyance section is grounded;

conveying the recording medium at a predetermined speed; ejecting a first ink droplet from a first nozzle of the plurality of nozzles;

after a predetermined amount of time, ejecting a second ink droplet from a second nozzle of the plurality of nozzles;

wherein the second nozzle is displaced from the first nozzle in a conveyance direction, and the first nozzle and the second nozzle overlap in a direction perpendicular to the conveyance direction; and wherein after the first ink droplet lands on the recording medium, the second ink droplet lands on the recording medium so that the second ink droplet overlaps with the first ink droplet and the second ink droplet lands on the recording medium before electrical discharging of the first ink droplet is completed.

* * * * *